US006293730B1

(12) United States Patent
Lee

(10) Patent No.: US 6,293,730 B1
(45) Date of Patent: Sep. 25, 2001

(54) APPARATUS FOR AND METHOD OF CONSTRUCTING CONCRETE BLOCK MAT UNDER WATER

(76) Inventor: Keun Hee Lee, 642-11 Ilwon-Dong, Kangnam-Ku 135-230 (KR)

( * ) Notice: Subject to any disclaimer, the term of this patent is extended or adjusted under 35 U.S.C. 154(b) by 0 days.

(21) Appl. No.: 09/404,049

(22) Filed: Sep. 23, 1999

(51) Int. Cl.[7] ..... E02B 3/14
(52) U.S. Cl. ..... 405/17; 405/20
(58) Field of Search ..... 405/15, 16, 17, 405/19, 20

(56) References Cited

U.S. PATENT DOCUMENTS

| | | | | |
|---|---|---|---|---|
| 1,619,331 | * | 3/1927 | Chenoweth | 405/17 |
| 1,822,602 | * | 9/1931 | Ross | 405/17 |
| 1,822,603 | * | 9/1931 | Ross | 405/17 |
| 4,201,494 | | 5/1980 | Crowe | 405/17 |
| 4,486,120 | | 12/1984 | Landry, Jr. | 405/17 |
| 4,906,130 | * | 3/1990 | Manely, Jr. et al. | 405/17 |
| 6,106,194 | * | 8/2000 | Angel et al. | 405/17 |

FOREIGN PATENT DOCUMENTS

WO 88/05842 8/1988 (WO) .

* cited by examiner

*Primary Examiner*—David Bagnell
*Assistant Examiner*—Frederick L. Lagman
(74) *Attorney, Agent, or Firm*—Vidas, Arrett & Steinkraus

(57) ABSTRACT

The invention provides an apparatus for and a method of constructing a concrete block mat consisting of unit concrete blocks interlocked together in the form of a mat by way of connections for adjacent interlocking members of those unit concrete blocks. There are also provided an apparatus for and a method of planarizing the ground under water using the concrete block mat. The apparatus for constructing a concrete block mat includes a frame, a plurality of frame, a plurality of block mat. The planarizing apparatus includes a configuration for maintaining those of the unit concrete blocks positioned at opposite ends of the concrete block mat to be inclined with respect to a plane of the concrete block mat in such a fashion that the concrete block mat has resistance reducing surfaces.

9 Claims, 7 Drawing Sheets

APPARATUS FOR AND METHOD OF CONSTRUCTING CONCRETE BLOCK MAT UNDER WATER

BACKGROUND OF THE INVENTION

1. Field of the Invention

The present invention relates to an apparatus for and a method of constructing a concrete block mat under water, and more particularly to an apparatus for and a method of constructing a concrete block mat consisting of unit concrete blocks interlocked together in the form of a mat by way of connections for adjacent interlocking members of those unit concrete blocks.

2. Description of the Prior Art

Constructions installed under water at rivers or seashores to block the activity of water or for other purposes are subjected to erosion or scouring at their foundations due to\the force of flowing water or wave force. In order to avoid such an erosion phenomenon, a variety of methods have been proposed.

The most representative method is to spread ripraps having a desired size throughout an under water location where erosion or scouring may occur, thereby forming a riprap layer at the under water location. The riprap layer is then planarized to have a trapezoidal shape. However, this method has drawbacks in that the riprap layer may easily collapse, thereby easily failing in its desired function. In particular, the work for planarizing the surface of the riprap layer is typically carried out by divers or underwater robots. However, where the planarizing work is conducted by divers, it is greatly influenced by the weather conditions of nature. As a result, there are drawbacks such as a reduction in workability, high labor costs, a lack of safety, and degraded reliability. Where the planarizing work is conducted by underwater robots, there is no drawback involved in the case using divers. In this case, however, it is difficult for the underwater robots to cope with the topology of the ground under water and a variation in working conditions. Use of underwater robots also involves high costs.

Recently, a method using concrete blocks has also been proposed. In accordance with this method, concrete blocks having a desired weight are prepared. These concrete blocks are spread one by one throughout an under water location, where erosion or scouring may occur, using a crane. After being placed under water, those concrete blocks are interlocked together in the form of a mat. However, this method has a variety of problems. That is, the placement of concrete blocks under water should be achieved in such a fashion that an accurate relative positional relationship is maintained between adjacent ones of those concrete blocks. To this end, divers continuously communicate with operators manipulating a crane on the ground so as to individually install the concrete blocks at accurate positions under water. After installing all of the necessary concrete blocks, the divers should conduct a task of interlocking the concrete blocks together. For these reasons, there is a difficulty in conducting the installation of concrete blocks. As a result, there are drawbacks such as a reduction in workability, a lack of safety, and degraded reliability. Where concrete blocks are installed in such a fashion that they are interlocked together in the form of a mat, it is necessary to planarize the under water location where those concrete blocks are to be installed before the concrete blocks are spread throughout that location. However, this planarization work involves the same drawbacks as those involved in the installation of the riprap layer as mentioned above.

SUMMARY OF THE INVENTION

Therefore, an object of the invention is to provide an apparatus for and a method of constructing a concrete block mat under water, which are capable of achieving an improvement in workability, a reduction in the danger of accidents, and an improvement in reliability.

Another object of the invention is to provide an apparatus for and a method of planarizing the ground under water, which are capable of achieving an improvement in workability, a reduction in the danger of accidents, and an improvement in reliability.

In accordance with one aspect, the present invention provides an apparatus for constructing a concrete block mat consisting of unit concrete blocks interlocked together in the form of a mat by way of connections for adjacent interlocking members of the unit concrete blocks, comprising: a frame including a plurality of laterally spaced longitudinal beams, and a plurality of longitudinally spaced lateral beams, each lateral beam being arranged between adjacent ones of the longitudinal beams and fixedly mounted at opposite ends thereof to the adjacent longitudinal beams; a plurality of frame connecting wires each fixedly mounted at one end thereof to an upper surface of the frame at a desired position and connected at the other end thereof to a crane wire, the frame connecting wires serving to lift the frame in a horizontal state when the crane wire moves upwardly; a plurality of block mat connecting wires each fixedly mounted at one end thereof to the frame at an associated one of longitudinally and laterally spaced positions, each of the block mat connecting wires extending at the other end thereof through a desired one of the block interlocking members of the concrete block mat while being locked to the frame, the block mat connecting wires serving to lift the concrete block mat in a horizontal state when the frame moves upwardly; locking means for locking the other end of each of the block mat connecting wires to the frame; and a lock releasing means for releasing the locked state of each of the block mat connecting wires.

In accordance with another aspect, the present invention provides a method for constructing a concrete block mat at a location under water, comprising the steps of: (A) interlocking a plurality of unit concrete blocks together on the ground above water by way of connections for adjacent block interlocking members of the unit concrete blocks to form a concrete block mat, prior to an installation of the unit concrete blocks under water; (B) connecting the block interlocking members of the concrete block mat to the frame by connecting wires, connecting the frame to a crane wire connected to a crane, and then lifting the frame by the crane, thereby causing the concrete block mat to be suspended from the frame; and (C) moving the concrete block mat in a state obtained at the step (B) to an installation location under water by the crane, installing the concrete block mat at the installation location, and separating the connecting wires from the block interlocking members, thereby causing the concrete block mat to be separated from the frame.

In accordance with another aspect, the present invention provides an apparatus for planarizing the ground under water, comprising: a frame including a plurality of laterally spaced longitudinal beams, and a plurality of longitudinally spaced lateral beams, each lateral beam being arranged between adjacent ones of the longitudinal beams and fixedly mounted at opposite ends thereof to the adjacent longitudinal beams; a concrete block mat consisting of unit concrete blocks interlocked together in the form of a mat by way of connections for adjacent interlocking members of the unit concrete blocks, the concrete block mat being suspended from the frame in a horizontal state while those of the unit concrete blocks positioned at opposite ends of the concrete block mat are inclined with respect to a plane of the concrete block mat in such a fashion that the concrete block mat has resistance reducing surfaces; a plurality of frame connecting wires each fixedly mounted at one end thereof to an upper surface of the frame at a desired position and connected at the other end thereof to a crane wire, the frame connecting wires serving to lift the frame in a horizontal state when the crane wire moves upwardly; a plurality of block mat connecting wires each fixedly mounted at one end thereof to the frame at an associated one of longitudinally and laterally spaced positions, each of the block mat connecting wires extending at the other end thereof through a desired one of the block interlocking members of the concrete block mat while being locked to the frame, the block mat connecting wires serving to lift the concrete block mat in a horizontal state when the frame moves upwardly; locking means for locking the other end of each of the block mat connecting wires to the frame; and a plurality of connecting members fixed to opposite ends of the frame, corresponding to respective opposite ends of the concrete block mat, the connecting members serving to connect the opposite ends of the frame to a towing ship and a crane, respectively.

In accordance with another aspect, the present invention provides a method for planarizing the ground under water, comprising the steps of: interlocking a plurality of unit concrete blocks together on the ground above water by way of connections for adjacent block interlocking members of the unit concrete blocks to form a concrete block mat; connecting the block interlocking members of the concrete block mat to the frame by connecting wires; maintaining those of the unit concrete blocks positioned at opposite ends of the concrete block mat to be inclined with respect to a plane of the concrete block mat in such a fashion that the concrete block mat has resistance reducing surfaces; connecting the frame to a crane wire extending from a crane, and lifting the frame by the crane, thereby causing the concrete block mat to be suspended from the frame; moving the concrete block mat suspended from the frame to the ground under water to be planarized, and seating the concrete block mat on the ground under water; connecting opposite ends of the frame, corresponding to respective opposite ends of the concrete block mat, to a towing ship and the crane, respectively; and moving the towing ship, thereby planarizing the ground under water while moving the concrete block mat along the ground under water.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
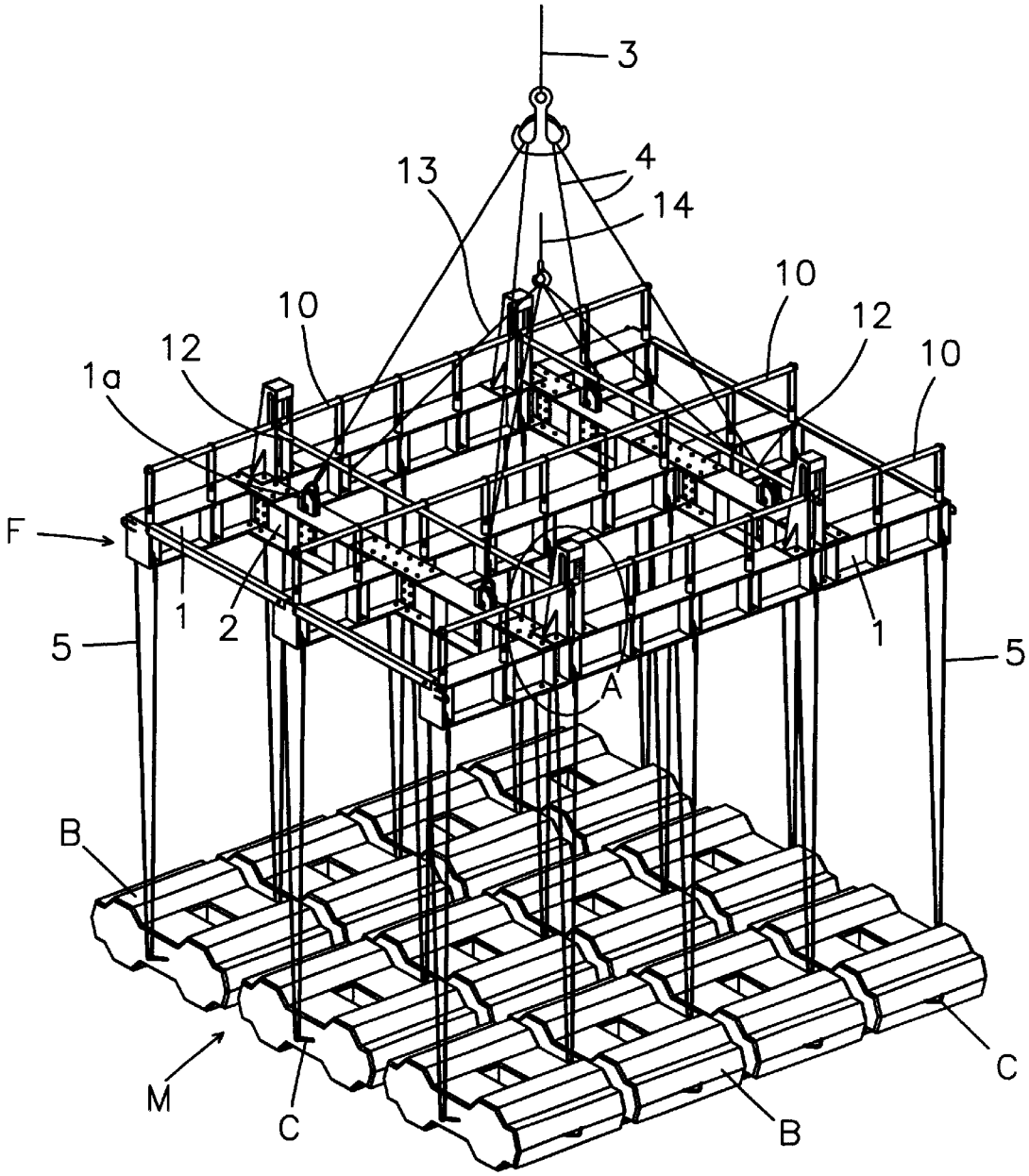
FIG. 1 is a perspective view illustrating an apparatus for constructing a concrete block mat under water in accordance with an embodiment of the present invention.

Referring to FIG. 1, there is an apparatus for constructing a concrete block mat under water in accordance with an embodiment of the present invention. This apparatus is adapted to construct a concrete block mat consisting of unit concrete blocks interlocked together in the form of a mat by way of connections for adjacent interlocking members of those unit concrete blocks.

As shown in FIG. 1, the apparatus includes a frame F. The frame F includes a plurality of laterally spaced longitudinal beams 1, and a plurality of longitudinally spaced lateral beams 2. Each lateral beam 2 is arranged between adjacent longitudinal beams 1 and fixedly mounted at opposite ends thereof to the adjacent longitudinal beams 1. Although the frame F is shown as including three longitudinal beams 1 and four lateral beams 2 in the embodiment illustrated in FIG. 1, the present invention is not limited thereto.

In order to lift the frame F using a crane, wire connecting members la are fixedly mounted on the upper surface of the frame F at desired positions, respectively. In the illustrated case, the wire connecting members la are mounted to the lateral beams 2, respectively. The one end of a frame connecting wire 4 is connected to each connecting member 1*a*. The other end of each frame connecting wire 4 is connected to a crane wire (denoted by the reference numeral 3*a* in FIG. 6) via a crane connecting wire 3. The mounting positions of the wire connecting members 1*a* are appropriately determined so that the frame F can be lifted while being horizontally maintained when the crane connecting wire 3 is raised.

The apparatus also includes a plurality of block mat connecting wires 5. Each block mat connecting wire 5 is fixedly mounted at one end thereof to the frame F at an associated one of longitudinally and laterally spaced positions. The other end of each block mat connecting wire 5 extends through a desired one of block interlocking eyes C of the concrete block mat M to be installed at a desired location under water, and is locked to the frame F by a locking means which will be described hereinafter. By means of these block mat connecting wires 5, the concrete block mat M is connected to the frame F, so that it is lifted along with the frame F when the frame F is raised. Since the concrete block mat M is constructed by interlocking a plurality of unit concrete blocks B together in such a fashion that adjacent block interlocking eyes C of adjacent unit concrete blocks B are interlocked to each other by a U-bolt or other means, it is important to horizontally maintain the concrete block mat M during its lifting. To this end, the block mat connecting wires 5 are fixedly mounted to the frame F at a plurality of positions uniformly spaced from one another in both the longitudinal and lateral directions.

In order to allow the concrete block mat M to be separated from the frame F after its installation at a desired location under water, it is necessary to separate the block mat connecting wires 5, which serve to connect the concrete block mat M to the frame F, from the concrete block mat M. To this end, the apparatus includes a locking means for locking the other end of each block mat connecting wire 5 to the frame F, and a lock releasing means for releasing the locked state of the other end of each block mat connecting wire 5.

Figure 2:
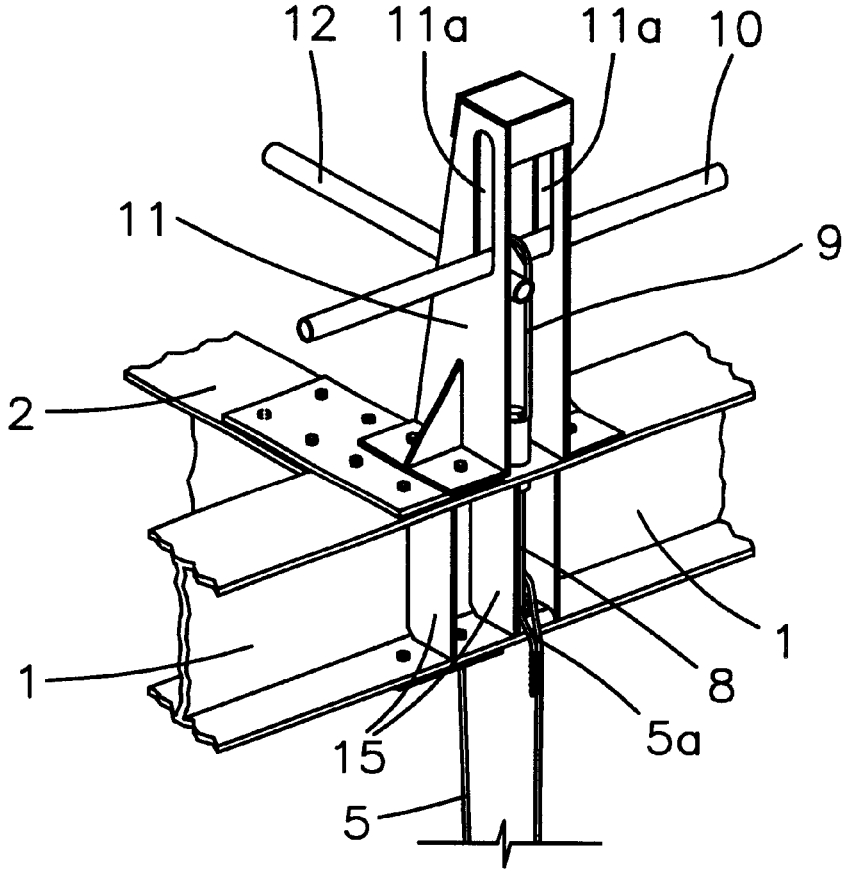
FIG. 2 is an enlarged perspective view corresponding to a portion A of FIG. 1 and illustrating a locking means and a lock releasing means included in the block mat constructing apparatus.
Figure 3:
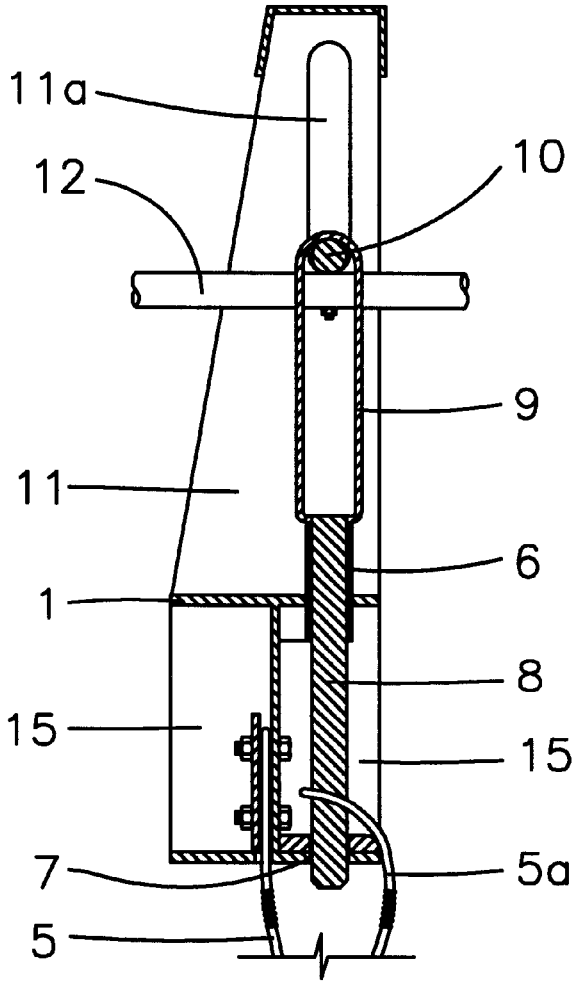
FIG. 3 is a cross-sectional view illustrating a state in which locking members included in the block mat constructing apparatus are at a locking position thereof.

As shown in FIGS. 2 and 3, the locking means comprises an eye 5*a* formed at the other end of each block mat connecting wire 5. The locking means also comprises a plurality of guide members 6 mounted to the frame F at a plurality of longitudinally and laterally spaced positions in such a fashion that they extend vertically through the frame F, respectively. The locking means further comprises a plurality of locking holes 7 formed through the frame F beneath the guide members 6, respectively, and a plurality of locking members 8 fitted in the guide members 6 in such a fashion that they slide vertically along the guide members 6, respectively. Each locking member 8 can slide vertically along a vertical guide passage defined in an associated one of the guide members 6 between a locking position where its lower end is engaged with an associated one of the locking holes 7 via the eye 5*a* of an associated one of the block mat connecting wires 5, thereby locking the associated block mat connecting wire 5, and a lock releasing position where its lower end is disengaged from the associated locking hole 7, thereby releasing the locked state of the associated block mat connecting wire 5.

On the other hand, the lock releasing means comprises a plurality of ring members 9 respectively coupled to the locking members 8. The lock releasing means also comprises a plurality of lock releasing members 10 each having a bar shape. Each lock releasing member 10 extends longitudinally through a group of ring members 9 longitudinally aligned together in a line. In order to guide upward and downward movements of an associated one of the lock releasing members 10 while supporting the lock release members 10, at least two support/guide members 11 are fixedly mounted to the upper surface of the frame F in such a fashion that they extend upwardly from the frame F. Each support and guide member 11 has at least one vertical guide slot 11*a* which extends vertically and receives an associated one of the lock releasing members 10 in such a fashion that the associated lock releasing member 10 extends longitudinally. In the illustrated case, each support and guide member 11 has two vertical guide slots 11*a* spaced from each other in the longitudinal direction of the frame F. All lock releasing members 10 are connected together by a plurality of laterally extending connecting members 12 each having a bar shape. In the illustrated case, there are two connecting members 12. The lock releasing means further comprises a plurality of lock releasing member connecting wires 13. As shown in FIG. 1, each lock releasing member connecting wire 13 is fixedly mounted at one end thereof to a desired one of the connecting members 12 at a desired position. The other end of each lock releasing member connecting wire 13 is connected to an assistant wire 14 of the crane. Accordingly, when the assistant wire 14 is raised, the lock releasing members 10 are upwardly moved along the vertical guide slots 11*a* of the support and guide members 11, thereby lifting the ring members 9 coupled thereto. As a result, each locking member 8 moves upwardly from its locking position to its lock releasing position. Thus, the locked state of each locking member 8 is released. In order to allow the lock releasing members 10 to move upwardly while being horizontally maintained, the lock releasing member connecting wires 13 are mounted to the connecting members 12 at positions uniformly spaced from one another in both the longitudinal and lateral directions, respectively.

Figure 4:
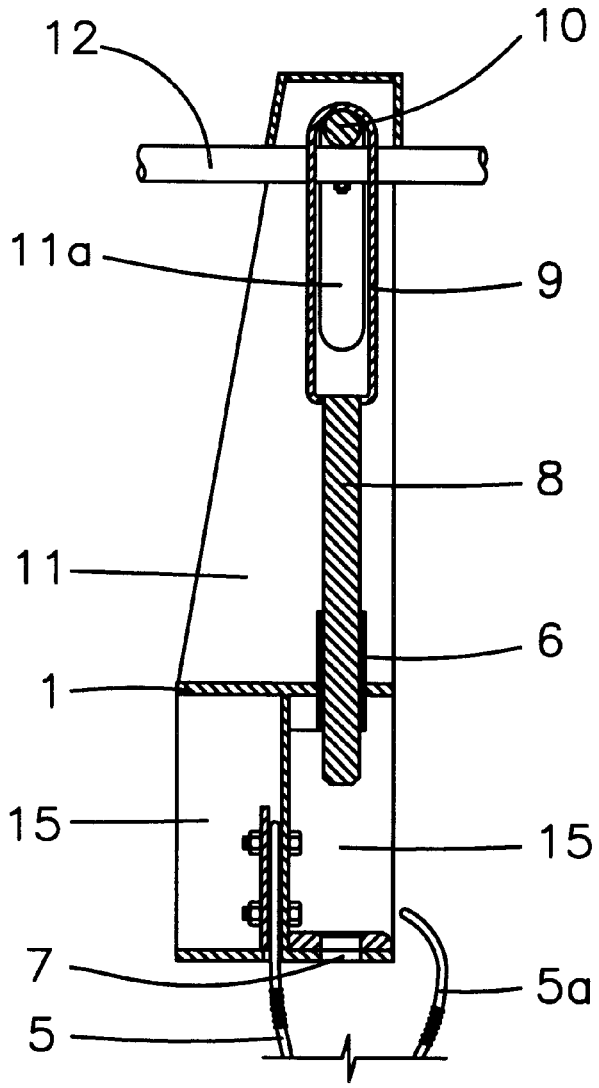
FIG. 4 is a cross-sectional view illustrating a state in which locking members included in the block mat constructing apparatus are at a lock releasing position thereof.

In FIGS. 2 to 4, the reference numeral 15 denotes reinforcing iron plates attached to portions of the frame F, in particular, the longitudinal beams 1, to which the load of the concrete block mat M is directly applied, in order to reinforce the longitudinal beams 1.

Where the area to be installed with the concrete block mat M is not planar, it should be planarized prior to the installation of the concrete block mat M. This planarizing work can be easily conducted using the concrete block mat M suspended from the apparatus of the present invention. Now, this will be described in detail.

Figure 5:
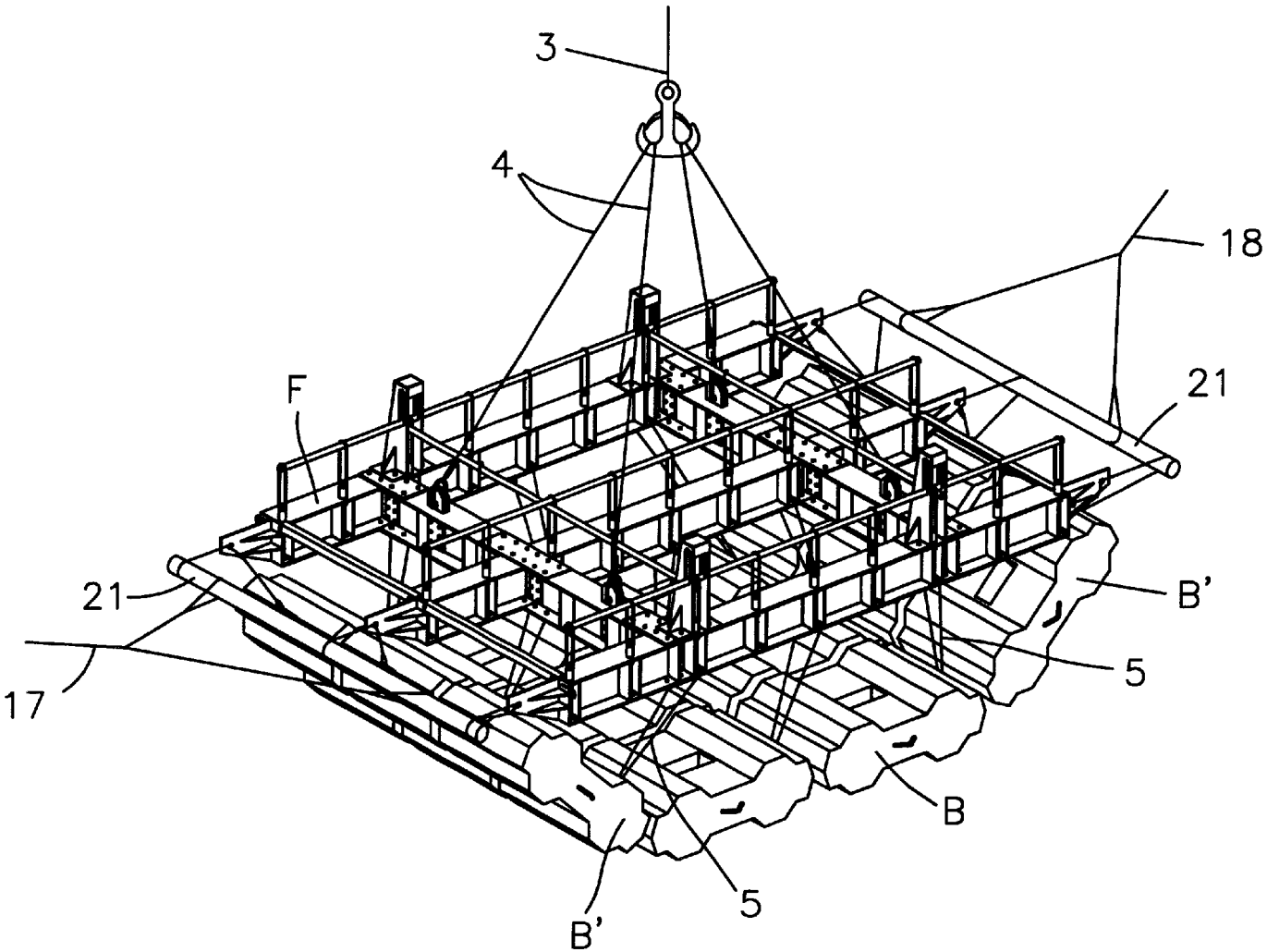
FIG. 5 is a perspective view illustrating an apparatus for planarizing the ground under water by use of the concrete block mat in accordance with the present invention.

Referring to FIG. 5, a planarizing apparatus is illustrated which is modified from the apparatus for constructing the concrete block mat M shown in FIG. 1 so that the latter apparatus can be used to planarize the area where the concrete block mat M is to be installed.

The planarizing apparatus of FIG. 5 has the same configuration as that of the concrete block mat installing apparatus of FIG. 1, except for a configuration in which concrete blocks corresponding to opposite ends of the concrete block mat M are maintained to be inclined by an angle of, for example, 45°, thereby serving as resistance reducing surfaces during a planarizing work, respectively, and a configuration for dragging the concrete block mat M by a towing ship. These configurations are adapted to allow the concrete block mat M suspended from the concrete block mat installing apparatus to be used as a means for planarizing the ground under water. Accordingly, the planarizing apparatus of FIG. 5 will be described only in conjunction with the above mentioned different configurations, for the convenience of description.

In order to maintain the concrete blocks (denoted by the reference character B' in FIG. 5), which form opposite ends of the concrete block mat M, to be inclined by a desired angle, for example, 45°, with respect to the plane of the concrete block mat M, the block mat connecting wires 5 extending through the outer interlocking eyes of the concrete blocks B' are maintained to be shortened, as compared to other block mat connecting wires 5. As a result, the concrete blocks B' can serve as resistance reducing surfaces during the planarizing work. Since this configuration can be appreciated by a skilled person in the technical field, no further description thereof will be made. In order to drag the concrete block mat M formed with the resistance reducing surfaces along the ground under water, for a planarizing work, connecting members 16 are mounted to each lateral end of the frame F from which the concrete block mat M is suspended. The connecting members 16 serve to connect the frame F to dragging wires 17 and 18 respectively connected to a towing ship denoted by the reference numeral 19 in FIG. 7 and a crane denoted by the reference numeral 20 in FIG. 7. In the illustrated embodiment of the present invention, the connecting members 16 are connected to the dragging wires 17 and 18 by means of connecting rods 21, respectively.

Now, the procedure for installing the concrete block mat M on a desired location under water using the concrete block mat installing apparatus according to the present invention and the procedure for planarizing the location using the planarizing apparatus according to the present invention will be described.

The procedure for installing the concrete block mat M when no planarization for the installation location is necessary will be first described.

In this case, a plurality of unit concrete blocks B are interlocked together on the ground above water by way of connections for adjacent interlocking members of those unit concrete blocks B to form a concrete block mat M, prior to an installation of the unit concrete blocks B under water.

The unit concrete blocks B may have a variety of shapes. In accordance with the present invention, concrete blocks having any shape may be used in so far as they have block interlocking members serving to interlock them together to form a concrete block mat. Although the number of unit concrete blocks B forming the concrete block mat M is typically 6 to 25, the present invention is limited thereto.

After the formation of the concrete block mat M, the concrete block mat installing apparatus, which is suspended from a crane (not shown) via the frame connecting wires connected to a crane wire of the crane, is arranged over the concrete block mat M at an appropriate level. At this time, the assistant wire 14 of the crane is in its upwardly pulled state, thereby pulling the lock releasing member connecting wires 13 to be pulled. As a result, the locking members 8 are maintained at their lock releasing position. After the installing apparatus of the present invention is arranged over the concrete block mat M, the eye-carrying end of each block mat connecting wire 5 extends to the frame F through desired interlocked block connecting eyes C in such a fashion that its eye 5*a* is vertically aligned with the an associated one of the locking holes 7 above the associated locking hole 7. In this state, each locking member 8 is downwardly moved to its locking position along an associated one of the guide members 6. That is, the lower end of each locking member 8 passes through the eye 5*a* of an associated one of the block mat connecting wires 5 and then engages with an associated one of the locking holes 7. The movement of each locking member 8 to its locking position is achieved by simply releasing the pulling force applied to the assistant wire 14 of the crane. When the pulling force is applied to the assistant wire 14, each locking member 8 is automatically moved to its locking position along the associated guide member 6 by virtue of its weight. Accordingly, the locking member 8 locks the eye 5*a* of an associated one of the block mat connecting wires 5. As a result, the concrete block mat M is connected to the frame F by the block mat connecting wires 5. In this state, pulling the crane wire causes the concrete block mat M to be lifted.

Thereafter, the concrete block mat M is moved to an installation location under water while being lifted by the crane, and then installed at the installation location. When the concrete block mat M is seated on the ground under water at the installation location, the tension applied to the crane wire due to the weight of the concrete block mat M decreases. In response to such a tension decrease, a pulling force from the crane is applied to he assistant wire 14. As the assistant wire 14 is pulled, the lock releasing members 10 are raised, thereby causing the locking members 8, which are connected to the lock releasing members 10 via the ring members 9, to move upwardly along the vertical guide slots 11*a* of the guide members 11. That is, each locking member 8 moves from its locking position to its lock releasing position, so that its lower end is separated from an associated one of the locking holes 7. As a result, the eyes 5*a* of the block mat connecting wires 5 are released from the locking members 8, respectively. When the installing apparatus is lifted by the crane in this state, the eye-carrying end of each block mat connecting wire 5 is separated from the associated block connecting eyes C of the concrete block mat M. Consequently, the concrete block mat M is separated from the installing apparatus.

Thus, the installation of the concrete block mat M is completed.

On the other hand, where the area to be installed with the concrete block mat M is not planar, it should be planarized prior to the installation of the concrete block mat M.

Figure 6:
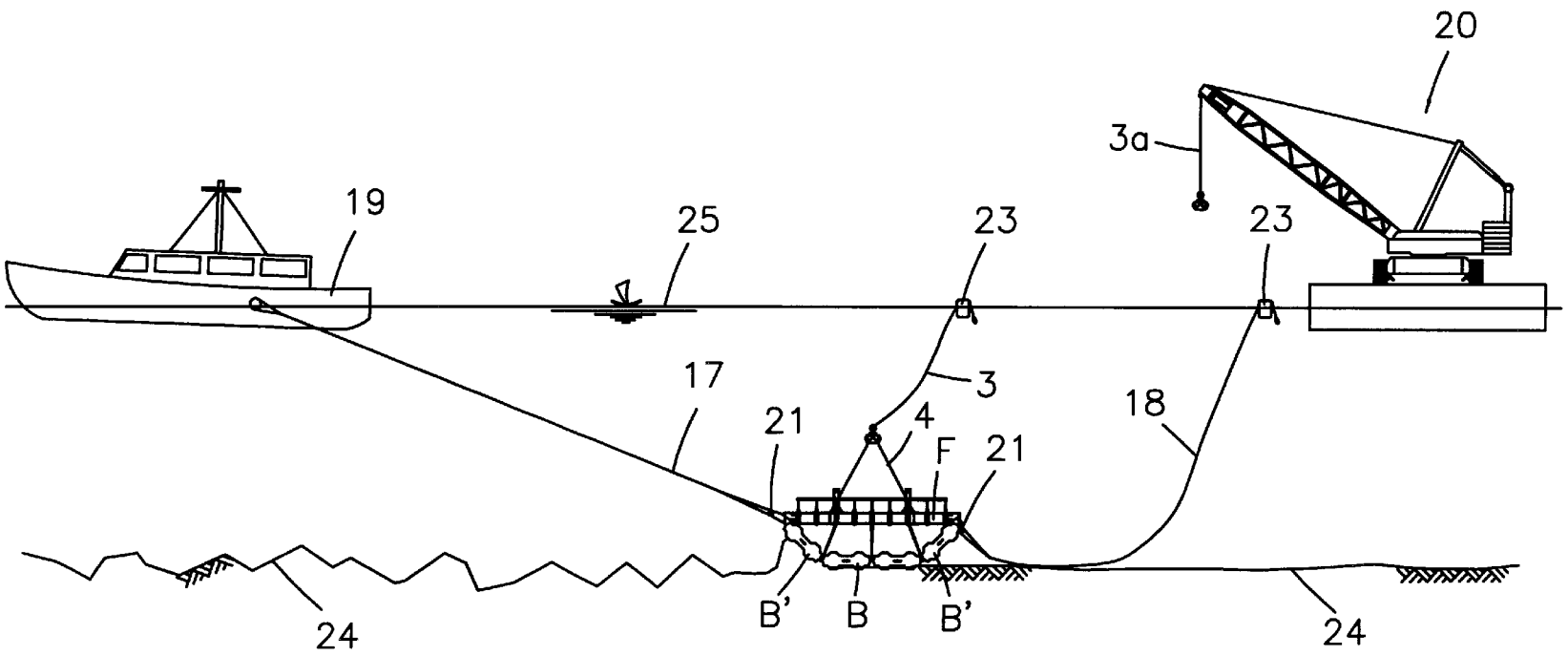
FIG. 6 is a schematic view illustrating the procedure for planarizing the ground under water by use of the planarizing apparatus shown in FIG. 5.

Referring to FIG. 6, an example is illustrated in which the ground under water is planarized using the above mentioned planarizing apparatus according to the present invention.

In order to use the concrete block mat M in planarizing the ground under water, the block mat connecting wires 5 extending through the outer interlocking eyes of the concrete blocks B' arranged at opposite ends of the concrete block mat M are maintained to be shortened, as compared to other block mat connecting wires 5. This state is illustrated in FIG. 5. Thereafter, the frame connecting wires 4 of the frame F are connected to the crane wire 3*a* by means of the crane connecting wires 3. At this time, the lock releasing member connecting wires 13 are in a state not connected to the assistant wire 14 of the crane 20. In this state, the concrete block mat M is seated on the ground under water at a desired location, using the crane, while depending from the frame F. Subsequently, the dragging wire 17 is connected to an associated one of the connecting rods 21 coupled to the connecting members 16 of the frame F. When the towing ship 19 moves in this state, the concrete block mat M is moved along the ground under water, thereby planarizing the ground under water. Since the concrete block mat M typically has a weight of about 24 tons while having resistance reducing surfaces, the planarizing work can be effectively achieved.

After the completion of the planarizing work, the concrete block mat M is moved again to the ground. On the ground, the concrete block mat M is then rendered to have a structure of FIG. 1. The resultant concrete block mat M is then installed at the planarized installation location under water. The procedure for installing the concrete block mat M is carried out in the same manner as mentioned above, except that the frame F turns 90° from the state of FIG. 5 to the state of FIG. 1. Accordingly, no further description will be made.

In FIG. 6, the reference numeral 23 denotes floats for keeping respective one-side end of the crane connecting wire 3 and dragging wire 18 which are connected at respective other-side ends thereof to the frame F.

Figure 7:
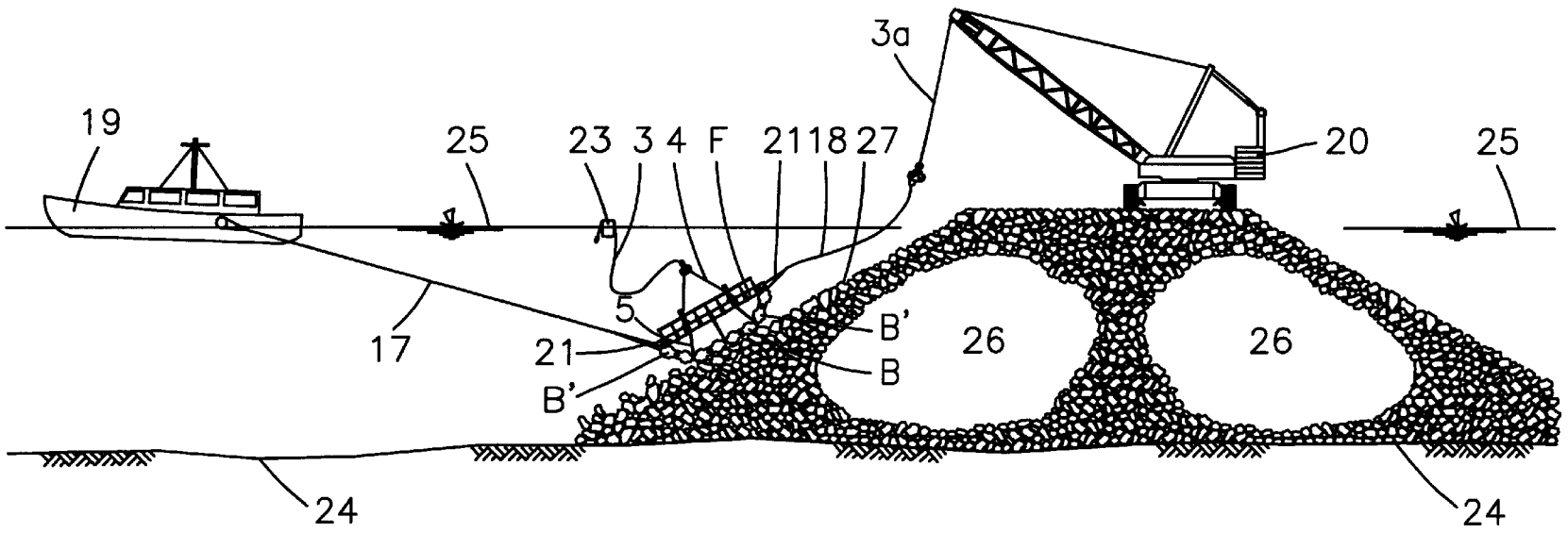
FIG. 7 is a schematic view illustrating the procedure for planarizing a riprap layer by use of the planarizing apparatus shown in FIG. 5.

The planarizing apparatus of the present invention can be effectively used in planarizing a riprap layer. Referring to FIG. 7, an example is illustrated in which a riprap layer is planarized using the planarizing apparatus of the present invention. The planarization work in this case is conducted in accordance with the same procedure as mentioned above. For the convenience of description, accordingly, no further description will be made.

Therefore, it should be understood that "the ground under water" not only includes the surface of the earth under water, but also includes the surface of a riprap layer naturally or artificially constructed under water.

In FIG. 7, the reference numeral 26 denotes the riprap layer, and the reference numeral 27 denotes the surface of the riprap layer 26.

As apparent from the above description, the present invention provides an apparatus for and a method of constructing a concrete block mat consisting of unit concrete blocks interlocked together in the form of a mat by way of connections for adjacent interlocking members of those unit concrete blocks.

In accordance with the present invention, the concrete block mat is assembled on the ground above water. Therefore, the present invention achieves an improvement in workability, a reduction in the danger of accidents, and an improvement in reliability, as compared to conventional methods in which unit concrete blocks are interlocked together in the form of a mat under water.

The present invention also provides an apparatus for and a method of planarizing the ground under water using the concrete block mat. In accordance with the planarizing apparatus and method, it is possible to achieve an improvement in workability, a reduction in the danger of accidents, and an improvement in reliability.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for constructing a concrete block mat consisting of unit concrete blocks interlocked together in the form of a mat by way of connections for adjacent interlocking members of the unit concrete blocks, comprising:

a frame including a plurality of laterally spaced longitudinal beams, and a plurality of longitudinally spaced lateral beams, each lateral beam being arranged between adjacent ones of the longitudinal beams and fixedly mounted at opposite ends thereof to the adjacent longitudinal beams;

a plurality of frame connecting wires each fixedly mounted at one end thereof to an upper surface of the frame at a desired position and connected at the other end thereof to a crane wire, the frame connecting wires serving to lift the frame in a horizontal state when the crane wire moves upwardly;

a plurality of block mat connecting wires each fixedly mounted at one end thereof to the frame at an associated one of longitudinally and laterally spaced positions, each of the block mat connecting wires extending at the other end thereof through a desired one of the block interlocking members of the concrete block mat while being locked to the frame, the block mat connecting wires serving to lift the concrete block mat in a horizontal state when the frame moves upwardly;

locking means for locking the other end of each of the block mat connecting wires to the frame; and a lock releasing means for releasing the locked state of each of the block mat connecting wires, wherein the locking means comprises:

an eye formed at the other end of each of the block mat connecting wires;

a plurality of guide members mounted to the frame at a plurality of longitudinally and laterally spaced positions in such a fashion that they extend vertically through the frame, respectively, each of the guide members having a vertical guide passage;

a plurality of locking holes formed through the frame beneath the guide members, respectively; and a plurality of locking members each fitted in an associated one of the guide members in such a fashion that it slides vertically along the vertical guide passage of the associated guide member between a locking position where a lower end thereof is engaged with an associated one of the locking holes via the eye of an associated one of the block mat connecting wires, thereby locking the associated block mat connecting wire, and a lock releasing position where the lower end is disengaged from the associated locking hole, thereby releasing the locked state of the associated block mat connecting wire.

2. The apparatus in accordance with claim 1, wherein the lock releasing means comprises:

a plurality of ring member groups each including a plurality of ring members longitudinally aligned together in a line and coupled to respective upper ends of the locking members;

a plurality of lock releasing members each extending longitudinally through an associated one of the ring member groups and serving to upwardly move the locking members respectively coupled to the ring members of the associated ring member group when it moves upwardly, thereby causing the locking members to move from the locking position to the lock releasing position;

a plurality of connecting members adapted to integrally connect the lock release members together;

a plurality of support/guide member groups each including at least two support/guide members fixedly mounted to the upper surface of the frame in such a fashion that they extend upwardly from the frame while being longitudinally spaced from each other, the support and guide members of each of the support and guide member groups serving to guide upward and downward movements of an associated one of the lock releasing members while supporting the lock release members; and a plurality of lock releasing member connecting wires each fixedly mounted at one end thereof to a desired one of the connecting members at a desired position and connected at the other end thereof to an assistant wire of a crane, the lock releasing member connecting wires serving to upwardly move the lock releasing members in a horizontal state when the assistant wire moves upwardly.

3. The apparatus in accordance with claim 2, wherein each of the support/guide members has at least one vertical guide slot extending vertically and receiving an associated one of the lock releasing members in such a fashion that the associated lock releasing member extends longitudinally.

4. A method for constructing a concrete block mat at a location under water, comprising the steps of:

(A) interlocking a plurality of unit concrete blocks together on the ground above water by way of connections for adjacent block interlocking members of the unit concrete blocks to form a concrete block mat, prior to an installation of the unit concrete blocks under water;

(B) connecting the block interlocking members of the concrete block mat to the frame by connecting wires, connecting the frame to a crane wire connected to a crane, and then lifting the frame by the crane, thereby causing the concrete block mat to be suspended from the frame; and (C) moving the concrete block mat in a state obtained at the step (B) to an installation location under water by the crane, installing the concrete block mat at the installation location, and separating the connecting wires from the block interlocking members, thereby causing the concrete block mat to be separated from the frame, wherein the step of separating the connecting wires from the block interlocking members at the step (C) is conducted in response to a reduction in tension occurring at the crane wire when the concrete block mat is seated on the installation location.

5. The method in accordance with claim 4, wherein the step (B) comprises the steps of:

(a) connecting the block interlocking members of the concrete block mat to the frame by connecting wires;

(b) maintaining those of the unit concrete blocks positioned at opposite ends of the concrete block mat to be inclined with respect to a plane of the concrete block mat in such a fashion that the concrete block mat has resistance reducing surfaces;

(c) connecting the frame to a crane wire extending from a crane, and lifting the frame by the crane, thereby causing the concrete block mat to be suspended from the frame;

(d) moving the concrete block mat suspended from the frame to an installation location under water by use of the crane, and seating on the ground under water;

(e) connecting opposite ends of the frame, corresponding to respective opposite ends of the concrete block mat, to a towing ship and the crane, respectively;

(f) moving the towing ship, thereby planarizing the ground under water while moving the concrete block mat along the ground under water;

(g) moving the concrete block mat to the ground above water after the completion of the planarization, and arranging the inclined concrete blocks of the concrete block mat in such a fashion that they are flush with the plane of the concrete block mat; and (h) lifting the frame in a state connected to the crane wire by use of the crane, thereby causing the concrete block mat to be suspended from the frame.

6. The method in accordance with claim 5, further comprising the steps of:

separating the connecting wires from the frame and the block interlocking members of the concrete block mat after the step (g), but before the step (h), thereby separating the concrete block mat from the frame; and turning the frame by an angle of 90°, and connecting again the block interlocking members of the concrete block mat to the frame by the connecting wires.

7. An apparatus for planarizing the ground under water, comprising:

a frame including a plurality of laterally spaced longitudinal beams, and a plurality of longitudinally spaced lateral beams, each lateral beam being arranged between adjacent ones of the longitudinal beams and fixedly mounted at opposite ends thereof to the adjacent longitudinal beams;

a concrete block mat consisting of unit concrete blocks interlocked together in the form of a mat by way of connections for adjacent interlocking members of the unit concrete blocks, the concrete block mat being suspended from the frame in a horizontal state while those of the unit concrete blocks positioned at opposite ends of the concrete block mat are inclined with respect to a plane of the concrete block mat in such a fashion that the concrete block mat has resistance reducing surfaces;

a plurality of frame connecting wires each fixedly mounted at one end thereof to an upper surface of the frame at a desired position and connected at the other end thereof to a crane wire, the frame connecting wires serving to lift the frame in a horizontal state when the crane wire moves upwardly;

a plurality of block mat connecting wires each fixedly mounted at one end thereof to the frame at an associated one of longitudinally and laterally spaced positions, each of the block mat connecting wires extending at the other end thereof through a desired one of the block interlocking members of the concrete block mat while being locked to the frame, the block mat connecting wires serving to lift the concrete block mat in a horizontal state when the frame moves upwardly;

locking means for locking the other end of each of the block mat connecting wires to the frame; and a plurality of connecting members fixed to opposite ends of the frame, corresponding to respective opposite ends of the concrete block mat, the connecting members serving to connect the opposite ends of the frame to a towing ship and a crane, respectively.

8. The apparatus in accordance with claim 7, wherein the locking means comprises:

an eye formed at the other end of each of the block mat connecting wires;

a plurality of guide members mounted to the frame at a plurality of longitudinally and laterally spaced positions in such a fashion that they extend vertically through the frame, respectively, each of the guide members having a vertical guide passage;

a plurality of locking holes formed through the frame beneath the guide members, respectively; and a plurality of locking members each fitted in an associated one of the guide members in such a fashion that it slides vertically along the vertical guide passage of the associated guide member between a locking position where a lower end thereof is engaged with an associated one of the locking holes via the eye of an associated one of the block mat connecting wires, thereby locking the associated block mat connecting wire, and a lock releasing position where the lower end is disengaged from the associated locking hole, thereby releasing the locked state of the associated block mat connecting wire.

9. A method for planarizing the ground under water, comprising the steps of:

interlocking a plurality of unit concrete blocks together on the ground above water by way of connections for adjacent block interlocking members of the unit concrete blocks to form a concrete block mat;

connecting the block interlocking members of the concrete block mat to the frame by connecting wires;

maintaining those of the unit concrete blocks positioned at opposite ends of the concrete block mat to be inclined with respect to a plane of the concrete block mat in such a fashion that the concrete block mat has resistance reducing surfaces;

connecting the frame to a crane wire extending from a crane, and lifting the frame by the crane, thereby causing the concrete block mat to be suspended from the frame;

moving the concrete block mat suspended from the frame to the ground under water to be planarized, and seating the concrete block mat on the ground under water;

connecting opposite ends of the frame, corresponding to respective opposite ends of the concrete block mat, to a towing ship and the crane, respectively; and moving the towing ship, thereby planarizing the ground under water while moving the concrete block mat along the ground under water.

* * * * *